US006562157B2

(12) United States Patent
Nonomura et al.

(10) Patent No.: US 6,562,157 B2
(45) **Date of Patent: *May 13, 2003**

(54) MANUFACTURING PROCESS OF NICKEL-BASED ALLOY HAVING IMPROVED HIGH TEMPERATURE SULFIDATION-CORROSION RESISTANCE

(75) Inventors: Toshiaki Nonomura, Yasugi (JP); Takehiro Ohno, Nagoya (JP); Toshihiro Uehara, Yonago (JP); Hiroshi Yakuwa, Fujisawa (JP); Matsuho Miyasaka, Yokohama (JP); Shuhei Nakahama, Kisarazu (JP); Shigeru Sawada, Tokyo (JP)

(73) Assignees: Hitachi Metals, Ltd., Tokyo (JP); Ebara Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/906,098

(22) Filed: Jul. 17, 2001

(65) Prior Publication Data

US 2002/0053376 A1 May 9, 2002

(30) Foreign Application Priority Data

Sep. 13, 2000 (JP) ..... 2000-278277

(51) Int. Cl.[7] ..... C22F 1/10
(52) U.S. Cl. ..... 148/677
(58) Field of Search ..... 148/677

(56) References Cited

U.S. PATENT DOCUMENTS

| | | | | |
|---|---|---|---|---|
| 4,121,950 A | | 10/1978 | Guimier et al. | |
| 4,612,062 A | | 9/1986 | Nazmy et al. | |
| 5,900,078 A | | 5/1999 | Yakuwa et al. | |
| 6,447,624 B2 | * | 9/2002 | Nonomura et al. | 148/677 |
| 2001/0039984 A1 | * | 11/2001 | Nonomura et al. | 148/677 |

FOREIGN PATENT DOCUMENTS

| | | |
|---|---|---|
| EP | 0 361 524 B1 | 5/1994 |
| EP | 0 790 324 A | 8/1997 |
| EP | 1 146 133 A | 10/2001 |

OTHER PUBLICATIONS

Patent Abstracts of Japan vol. 008, No. 011 (C–205), Jan. 18, 1984 & JP 58 177445 A (Sumitomo Kinoku Kogyo KK), Oct. 18, 1983.

"Metal Handbook, Ninth Edition, vol. 14, Forming and Forging" Apr. 1998, ASM International, USA XP002180941; p. 265, col. 2, paragraph 3.

* cited by examiner

*Primary Examiner*—Roy King
*Assistant Examiner*—Harry D. Wilkins, III
(74) *Attorney, Agent, or Firm*—Sughrue Mion, PLLC

(57) ABSTRACT

A manufacturing method, particularly a forging treatment and a heat treatment method of a Ni-based alloy having sulfidation-corrosion resistance used for component members of corrosion-resistant high-temperature equipment, that is, Waspaloy (a trademark of United Technologies) or its improved Ni-based alloy wherein the high temperature sulfidation-corrosion resistance of the alloy can be improved while maintaining hot strength properties is disclosed. A Ni-based alloy used for the method consists essentially of 0.005 to 0.1% C, 18 to 21% Cr, 12 to 15% Co, 3.5 to 5.0% Mo, not more than 3.25% Ti and 1.2 to 4.0% Al (expressed in mass percentage), with the balance substantially comprising Ni. In the manufacturing method of a Ni-based alloy having improved sulfidation-corrosion resistance, the alloy is, after finish hot-worked at a temperature below carbide dissolving temperature, subjected to solution treatment at a temperature below the carbide dissolving temperature and below re-crystallization temperature and subjected to stabilizing treatment and aging treatment.

6 Claims, 4 Drawing Sheets

HEATED AT 1010°C

HEATED AT 1080°C

HEATED AT 1010°C 100μm

HEATED AT 1040°C 100μm

MANUFACTURING PROCESS OF NICKEL-BASED ALLOY HAVING IMPROVED HIGH TEMPERATURE SULFIDATION-CORROSION RESISTANCE

BACKGROUND OF THE INVENTION

1. Field of the Invention

The present invention relates to a manufacturing method of a heat-resistant alloy having excellent high temperature sulfidation-corrosion resistance suitable for use in apparatuses used in high temperature corrosion environments, particularly in sulfidation-corrosion environment containing $H_2S$, $SO_2$, etc., such as expander turbines recovering the energy from exhaust gas from fluid catalytic cracking unit in a petroleum refining system, for example.

2. Description of the Related Art

Heat-resistant nickel-based alloys having excellent strength and corrosion resistance at elevated temperature have heretofore been widely used for members exposed to high temperatures, such as expander turbine rotors. A typical example of such alloys is what is known as Waspaloy (a registered trademark of United Technologies).

Heat-resistant nickel-based alloys used for members exposed to elevated temperatures usually gain their high temperature strength through the precipitation strengthening of intermetallic compounds called the γ' phase. Since the γ' phase has $Ni_3(Al, Ti)$ as its basic composition, Al and Ti are normally added to these alloys.

In high-temperature equipment exposed to a combustion-gas atmosphere, such as turbine and boilers, on the other hand, the so-called "hot corrosion" phenomenon involving molten salts such as sulfates, V, Cl, etc., is known. It is reported that sulfidation corrosion caused by the direct reactions of gases not involving molten salts with metals occurs with nickel-based alloys at approximately 700° C. or higher. This phenomenon is attributable to the formation of Ni—$Ni_3S_2$ eutectics of low melting points.

In order to accomplish energy conservation in oil refineries, on the other hand, a system for recovering energy in the gas exhausted from the fluid catalytic cracking unit has been developed. When Waspaloy, a typical Ni-based superalloy, was used for gas-expander turbine blades in such equipment, sulfidation corrosion occurred at the roots of the rotor blades though it was used in a temperature region far lower than the temperature heretofore considered critical.

Closer scrutiny of this phenomenon revealed that although corrosion developed along grain boundaries, no molten salts were present at corroded areas, indicating that the corrosion was caused by the direct reactions of the metal with gases. Such an intergranular sulfidation corrosion of a Ni-based superalloy in a sulfur-laden gas environment containing no molten salts in a temperature region lower than the eutectic point of Ni—$Ni_3S_2$ has been scarcely observed in the past.

To solve this problem, the inventors of U.S. Pat. No. 5,900,078 issued May 4, 1999 studied in detail the effects of alloy elements on the sulfidation behavior of Waspaloy in a sulfur-laden gas environment in a temperature region lower than the eutectic point of Ni—$Ni_3S_2$, and elucidated that the sulfidation layer in the alloy including grain boundaries is enriched in Ti, Al and Mo contained in the alloy, and that the Ti and Al contents of the alloy have a marked effect on the sulfidation-corrosion resistance of the alloy.

As a result, a high temperature sulfidation-corrosion-resistant Ni-based alloy containing 12 to 15% Co, 18 to 21% Cr, 3.5 to 5% Mo, 0.02 to 0.1% C, not more than 2.75% Ti and not less than 1.6% Al, with the balance substantially comprising Ni, excluding impurities, has been proposed, as disclosed in U.S. Pat. No. 5,900,078.

The alloy disclosed in U.S. Pat. No. 5,900,078 has attracted trade attention as a heat-resistant Ni alloy whose sulfidation-corrosion resistance has been dramatically improved by reducing the Ti content and increasing the Al content among the additional elements of Waspaloy.

The present inventors, however, made clear after further study of the alloy that the sulfidation-corrosion resistance, particularly corrosion resistance at the alloy grain boundaries, that is, intergranular sulfidation-corrosion resistance of even the alloy having improved sulfidation-corrosion resistance, as disclosed in U.S. Pat. No. 5,900,078 could be changed if manufactured with different methods. The same hold true with Waspaloy that has been widely known.

Since heat treatment conditions for these heat-resistant Ni alloys have often been determined, placing emphasis mainly upon strength characteristics and hot workability, the resulting alloys have not necessarily shown good high temperature sulfidation-corrosion resistance.

SUMMARY OF THE INVENTION

It is therefore an object of the present invention to provide a manufacturing method, particularly a finish hot working and heat treatment method for improving the sulfidation-corrosion resistance of the sulfidation-corrosion-resistant Ni-based alloy disclosed in U.S. Pat. No. 5,900,078 and other Ni-based alloys used for members of corrosion-resistant high-temperature equipment while maintaining the same high-temperature strength characteristics as those of conventional alloys.

After studying the intergranular sulfidation-corrosion characteristics of the sulfidation-corrosion resistant Ni-based alloy disclosed in U.S. Pat. No. 5,900,078 and Waspaloy, which were subjected to various heat treatment processes, the present inventors discovered that grain boundaries are corroded because carbides chiefly consisting of Cr are precipitated in the grain boundaries, causing Cr to reduce in the vicinity of grain boundaries, and Cr-depleted zones to be formed along the grain boundaries. Consequently, the present inventors have conceived the present invention based on the assumption that sulfidation corrosion at grain boundaries can be controlled by inhibiting the formation of Cr-depleted zones at the grain boundaries.

That is, the present invention is a manufacturing method of a Ni-based alloy containing 0.005 to 0.1% C, 18 to 21% Cr, 12 to 15% Co, 3.5 to 5.0% Mo, not more than 3.25% Ti, and 1.2 to 4.0% Al in mass percent, with the balance substantially consisting of Ni, and the manufacturing method of the Ni-based alloy having improved sulfidation-corrosion resistance, comprising the steps of, after finish hot working at a temperature below the carbide dissolving temperature, solution treating at a temperature below carbide dissolvingtemperature and below re-crystallization temperature and then stabilizing treating and aging treating the alloy.

Preferably, the manufacturing method comprises the stabilizing treatment for 1 to 16 hours at not lower than 860° C. and not higher than 920° C., and the aging treatment for 4 to 48 hours at not lower than 680° C. and not higher than 760° C. More preferably, the manufacturing method further comprises a secondary aging treatment for not less than 8 hours at not lower than 620° C. and not higher than the primary aging treatment temperature minus 20° C.

The present invention is a manufacturing method of a Ni-based alloy having improved sulfidation-corrosion resistance whose desirable alloy composition is Ti: not more than 2.75%, Al: 1.6 to 4.0% in mass percent, and more preferably any one of B: not more than 0.01%, and Zr: not more than 0.1% in mass percent.

BRIEF DESCRIPTION OF THE DRAWINGS

FIGS. 2A and 2B show cross-sectional micrographs of specimens after heated at 1010° C. and 1040° C., respectively.

DETAILED DESCRIPTION OF THE PREFERRED EMBODIMENTS

Figure 1A:
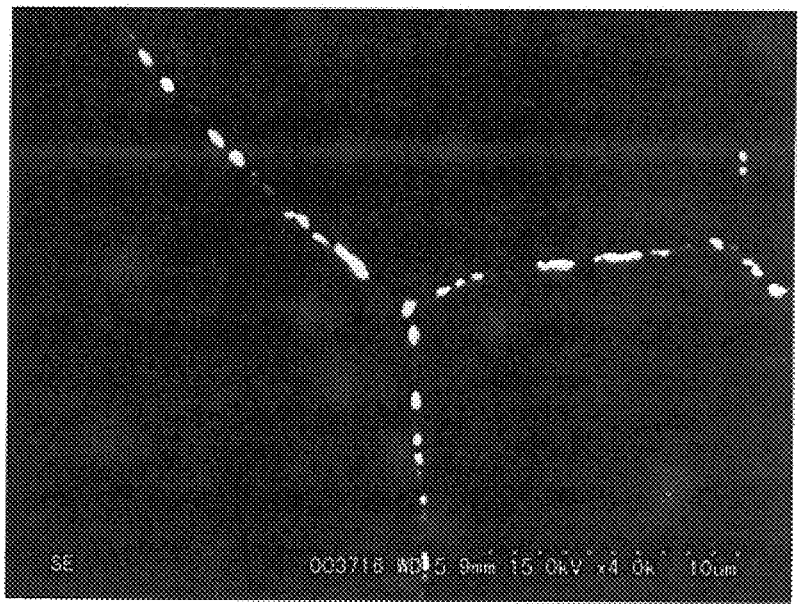
FIGS. 1A and 2B show cross-sectional micrographs of grain boundaries of specimens after heated at 1010° C. and 1080° C., respectively.

The present invention was made based on the conception that sulfidation corrosion along grain boundaries can be suppressed by inhibiting the formation of Cr-depleted zones along the grain boundaries; the conception was derived from the observation results reached during the study of the intergranular sulfidation-corrosion characteristics of a high temperature sulfidation-corrosion-resistant Ni-based alloy disclosed in U.S. Pat. No. 5,900,078 and Waspaloy that grain boundaries are corroded because Cr-depleted zones are formed along the grain boundaries as carbides chiefly consisting of Cr are precipitated in the grain boundaries to reduce Cr-content in the vicinity of the grain boundaries.

The first key point of the present invention is reducing the finish hot working temperature of a Ni-based alloy having a particular composition to below the carbide dissolving temperature. Note that the term carbides used in the present invention refers to Cr carbides.

By finish hot working a Ni-based alloy at a temperature below the carbide dissolving temperature, an alloy structure having carbides can be obtained. Cr carbides which have existed before the finish hot working partially dissolve in the solid solution while additional Cr-carbides precipitate in grain boundaries during the finish hot working. Consequently, Cr-depleted zones are formed around the Cr carbides at the initial stage of the finish hot working, but Cr-depleted zones in the vicinity of the Cr carbides disappear as Cr diffusion proceeds because the alloy is held at elevated temperatures during the finish hot working. If the alloy is slowly cooled after the finish hot working, a certain amount of Cr carbides may precipitate in the grain boundaries, forming Cr-depleted zones. These Cr depleted zones can disappear due to the diffusion of Cr during the solution heat treatment after the finish hot working.

Furthermore, finish hot working at relatively low temperatures below the carbide dissolving temperature tends to cause strains to be left in the alloy, and the residual strains to accelerate Cr diffusion during the subsequent solid-solution and stabilizing treatments, working favorably to the disappearance of Cr-depleted zones.

Now, let us take forging as an example of hot working. Forging can be roughly divided into the cogging process where ingots are reduced to billets, blooms and other intermediate shapes, and the finish forging process where billets or blooms are further reduced to a shape close to the desired final shape. The present invention is intended to define the finish hot working for reducing metal billets or blooms into a shape near the desired final shape. The term hot working used in the present invention includes rolling, extrusion and various other hot working methods, in addition to the aforementioned forging.

The Ni alloy manufactured with the present invention is often applied to relatively large-sized discs, etc. In such applications, forging is suitable for the purpose because the material used for such hot working is also of a large size. Furthermore, finish hot working at relatively low temperatures, as with the present invention, involves a high degree of deformation resistance, leading to a heat buildup. This results in a heat-up of the material, making it difficult to hold the material temperature below the carbide dissolving temperature, as defined by the present invention.

Consequently, press forging is most suitable because this is a hot working process that can be applied to the finish hot working of large Ni-alloy materials, and can relatively easily adjust the degree of working so as to hold the material to low temperatures below the carbide dissolving temperature to prevent heat buildup in the material.

Next, the finish hot-worked Ni-based alloy is subjected to solid-solution heat treatment. The second key point of the present invention is to carry out solid-solution heat treatment by setting the solid-solution heat treatment temperature to a temperature below the carbide dissolving temperature and below the recrystallization temperature. The chief purpose of this treatment is to prevent the formation of new grain boundaries due to recrystallization while leaving the Cr carbides obtained during the finish hot working as they are (or leaving the Cr carbides not dissolved in the solid solution completely), thereby minimizing the precipitation of new Cr carbides during stabilizing and aging treatments to be performed after the solid-solution treatment, aside from the purpose of allowing Ti and Al as γ'-forming elements to dissolve into the solid solution.

That is, the subsequent stabilizing and aging treatments inevitably entail the precipitation of Cr carbides in grain boundaries, as will be described later. The Cr carbides dissolved in the solid solution during the solid-solution treatment may precipitate again during the succeeding stabilizing and aging treatments, forming Cr-depleted zones. If the Cr carbides obtained during the finish hot working is left, on the other hand, the amount of Cr-carbide precipitation in grain boundaries during stabilizing or aging treatment is reduced, leading to a reduction in Cr-depleted zones.

Moreover, if austenite grains in the alloy are recrystallized, forming new grain boundaries during a solid-solution treatment whose solution treatment temperature is below the carbide dissolving temperature, the newly formed grain boundaries have no carbide precipitation. Thus, when the solid-solution treatment is followed by stabilizing and aging treatments, a large amount of new Cr carbides are precipitated in the grain boundaries, resulting in the formation of a large amount of Cr-depleted zones, which could not disappear adequately without considerably long time exposure of stabilizing and aging treatments. The net result is a product having low sulfidation-corrosion resistance. In the present invention, therefore, solid-solution treatment is carried out at a temperature below the recrystallization temperature to prevent new austenite grain boundaries from being formed during the solid-solution treatment.

In addition, the residual strains caused by the above-mentioned finish hot working at low temperatures and the solid-solution treatment at a temperature below the recrystallization temperature facilitate the diffusion of Cr during the stabilizing treatment, acting favorably in disappearance of the Cr-depleted zones.

Next, the present invention involves stabilizing and aging treatments after the aforementioned solid-solution heat treatment. Although the chief purpose of the stabilizing and aging treatments is improving the strength of the alloy, the present invention can also improve corrosion resistance, in addition to improving strength, if stabilizing and aging treatments are carried out under conditions specified as a desirable range by the present invention. That is, new Cr carbides can be fully precipitated and therefore Cr can be diffused during the stabilizing treatment, thereby causing Cr to diffuse into the Cr-depleted zones resulting from the precipitation of Cr carbides and disappearing of the Cr-depleted zones, by carrying out the stabilizing treatment under conditions set higher than the normally practiced ones (e.g., 843° C.×4 hr., air-cooled), namely at a higher temperature and for a longer time so that Cr carbides can be precipitated and Cr can be diffused adequately. By recovering Cr-depleted zones during stabilizing treatment and causing as much Cr carbides as possible to precipitate at this stage in this way, the precipitation of additional Cr carbides and the resulting formation of Cr-depleted zones during the subsequent aging (age hardening) treatment can be minimized.

If the aforementioned stabilizing treatment is followed by an inadequate aging (age hardening) treatment, however, a new precipitation of additional Cr carbides and the resulting formation of Cr-depleted zones could take place to aggravate sulfidation-corrosion resistance of the alloy. The present invention is therefore to inhibit the precipitation of Cr carbides by setting age hardening conditions to a lower level than the conventional aging treatment temperature (e.g., at 760° C. for 16 hours and air-cooled).

Taking into account the fact that stabilizing and aging (age hardening) treatment conditions greatly affect the strength properties of alloys, as described earlier, heat treatment conditions according to the present invention were set so as to impart adequate strength properties to the alloy. That is, the heat treatment conditions of the present invention were determined with primary emphasis placed on the corrosion resistance of the alloy while carefully studying the conditions that can also ensure adequate strength, unlike the conventional heat treatment conditions that had placed emphasis on strength alone.

The stabilizing and aging treatment will be described in further detail below.

As described in EXAMPLES later, studies by the present inventors revealed that the formation of Cr-depleted zones due to the precipitation of Cr carbides in alloy grain boundaries is markedly facilitated in a temperature region higher than 760° C. and lower than 860° C. Consequently, the present invention makes it possible to improve the high-temperature sulfidation-corrosion resistance of the alloy by intergranular precipitating as much Cr carbides as possible while inhibiting the formation of Cr-depleted zones by subjecting the alloy to stabilizing treatment at a temperature higher than this temperature region, and inhibiting the precipitation of Cr carbides in alloy grain boundaries by subjecting the alloy to aging (age hardening) treatment at a temperature lower than the temperature region.

Stabilizing and aging (age hardening) treatments, on the other hand, have a role of facilitating the precipitation and growth of the γ' phase that contributes to the high-temperature strength of alloys. If the stabilizing treatment temperature is higher than 920° C., however, the γ' phase is markedly coarsened, aggravating the high-temperature strength. Even when stabilizing treatment is carried out at a temperature not lower than 860° C. and not higher than 920° C. for not longer than 1 hour, then the γ' phase precipitates and grows inadequately, and if the stabilizing treatment time is longer than 16 hours, the γ' phase tends to be coarsened, leading to lowered high-temperature strength. Consequently, stabilizing treatment conditions were specified as a temperature range not lower than 860° C. and not higher than 920° C. for 1 to 16 hours.

When aging (age hardening) conditions are a temperature region lower than 680° C., the γ' phase is precipitated and grown insufficiently, resulting in insufficient high-temperature strength. Even when the temperature region is in the range of not lower than 680° C. and not higher than 760° C., an aging time shorter than 4 hours would lead to insufficient precipitation and growth of the γ' phase, while an aging time longer than 48 hours would facilitate the precipitation of carbides in alloy grain boundaries. Thus, the aging (age hardening) conditions were specified as follows; an aging temperature not lower than 680° C. and not higher than 760° C. and aging time from 4 to 48 hours.

In the present invention, secondary aging treatment should preferably be performed at a temperature not higher than an aging (age hardening) treatment temperature −20° C. and not lower than 620° C. for not less than 8 hours. In other words, secondary aging (age hardening) treatment should be performed in a temperature range lower than aging (age hardening) treatment temperature. With this secondary aging (age hardening) treatment, precipitation strengthening by the refined γ' phase can be further facilitated without precipitation of Cr carbides in grain boundaries, thus making it possible to further improve strength without sacrificing sulfidation-corrosion resistance.

A secondary aging (age hardening) treatment temperature lower than 620° C. would hardly precipitate the γ' phase, with little effect of increasing strength, whereas a secondary aging (age hardening) treatment temperature exceeding −20° C. of aging (age hardening) treatment temperature would coarsen the γ' phase precipitated during aging (age hardening) treatment, contributing little to the strength enhancing effect of the precipitation of the refined γ' phase. It is for this reason that the upper-limit of the secondary aging (age hardening) treatment temperature was set to the aging (age hardening) temperature minus 20° C. Since too short a secondary aging (age hardening) treatment time would reduce the contribution of the precipitation of the refined γ' phase to precipitation strengthening, the secondary aging (age hardening) treatment time was set to not less than 8 hours.

As described in detail in the foregoing, the manufacturing method of a Ni-based alloy according to the present invention can improve the sulfidation-corrosion resistance of the alloy while imparting excellent strength at elevated temperatures to the alloy. In order to give full play to the properties of the alloy, however, it is necessary to optimize the alloy composition needed to improve the sulfidation-corrosion resistance of the alloy itself.

In the following, alloy compositions suitable for use in the present invention will be described. Note that mass percentage is used throughout this Specification unless otherwise specified.

C forms carbides of TiC with Ti, and $M_6C$, $M_7C_3$ and $M_{23}C_6$ types with Cr and Mo. These carbides help inhibit the coarsening of grain sizes. Moreover, they are essential elements for the present invention since they help strengthen grain boundaries as adequate amounts of $M_6C$ and $M_{23}C_6$ are precipitated at the grain boundaries. The above effects, however, cannot be expected if the carbon content is less than 0.005%. C contents over 0.1%, on the other hand, not only reduce the necessary amount of Ti for precipitation hardening, but also excessively increases the Cr carbides precipitated in grain boundaries, thus weakening the grain boundaries and requiring much longer time for precipitating Cr carbides at the grain boundaries and recovering Cr-depleted zones. C was therefore limited to 0.005 to 0.1%.

Cr forms a stable and dense oxide layer, improving oxidation resistance in a corrosive environment where oxidation factors such as atmosphere, oxidizing acids and high-temperature oxidation act simultaneously. When combined with C, Cr precipitates carbides such as $Cr_7C_3$ and $Cr_{23}C_6$, showing the effects of improving elevated-temperature strength. If Cr content is less than 18%, however, oxidation resistance among the aforementioned effects become insufficient, and a Cr content exceeding 21% facilitates the formation of harmful intermetallic compounds, such as the σ phase. Cr was therefore limited to 18 to 21%.

Co in a Ni-based alloy itself exists in a solid solution having a matrix strengthening effect, and also has an strengthening effect as it reduces the amount of solid solution of the γ' phase in the Ni-based matrix and increases the amount of γ' precipitation. Co contents less than 12% are insufficient in showing the above effects, while Co contents exceeding 15% may produce harmful intermetallic compounds, such as the a phase, lowering creep strength. Co was therefore limited to 12 to 15%.

Mo, which mainly dissolves in the γ and γ' phases, enhances high-temperature strength, and also serves to improve resistance to corrosion from hydrochloric acid. Mo contents less than 3.5%, however, are insufficient in showing the above effects, while Mo contents exceeding 5.0% destabilize the matrix structure. Mo was therefore limited to 3.5% to 5.0%.

Ti and Al, which form the γ' phase in the form of $Ni_3(Al, Ti)$, are important elements contributing to precipitation hardening. With increasing Ti content, however, sulfidation corrosion in an alloy is facilitated. The upper limit of Ti content was therefore set to 3.25%. The more preferable upper limit of Ti content to inhibit the propagation of sulfidation corrosion is 2.75%. Too low Ti contents, on the other hand, make it difficult to maintain the required high-temperature strength. The Ti content not lower than 0.5% is the minimum level.

When the Ti content is kept within the aforementioned range, an Al content not less than 1.2% must be added in order to maintain high-temperature strength by forming a sufficient amount of the γ' phase. An increase in the Al content is effective in improving not only high-temperature strength but also sulfidation corrosion resistance. Excessive addition of Al, however, could cause small elongation, poor reduction of area and poor hot workability at elevated temperatures. The upper limit of Al content was set to 4.0%. To ensure a balance among high-temperature strength, sulfidation-corrosion resistance, high-temperature ductility and hot workability, the lower limit of Al content should preferably be set to 1.6%. By controlling the Ti and Al contents, high-temperature strength and sulfidation-corrosion resistance can be improved.

In the present invention, any one or both of not more than 0.01% of B and not more than 0.1% of Zr can be contained as an element or elements that are not essential but can inhibit intergranular fracture by increasing the intergranular strength. If B and Zr are added in quantities exceeding 0.01% and 0.1%, respectively, however, they lower the melting point of grain boundaries, making the alloy vulnerable to melt fracture. The B and Zr contents were therefore limited to not more than 0.01% and not more than 0.1%, respectively.

Furthermore, 0.02%, max. Mg can be added as an element that helps improve hot workability because finish hot working temperature has to be set to a slightly lower level in the present invention, as described earlier. The upper limit should be set at 0.02% since a Mg addition exceeding 0.02% might form magnesium intermetallic compounds of low melting point in the grain boundaries, inhibiting hot workability. Not more than 0.02% Ca can also be added as an element having similar effects.

The following elements can also be included in the alloy according to the present invention within specified ranges; P≦0.04%, S≦0.01%, Cu≦0.30%, V≦0.5%, Y≦0.3%, rare-earth elements≦0.02%, W≦0.5%, Nb≦0.5% and Ta≦0.5%.

EXAMPLES

Referring to EXAMPLES, the present invention will be described in more detail below.

Alloys were manufactured in a vacuum induction furnace, cast in vacuum, and forged into 60×130×1000 mm rectangular billets and 500 mm-diameter or 1400 mm-diameter discs simulating discs of the gas expander turbine, which were used as test specimens. Chemical compositions of the specimens are shown in TABLE 1. Alloy A was an alloy disclosed in U.S. Pat. No. 5,900,078, and Alloy B was an alloy commonly known as Waspaloy.

TABLE 1

(Mass %)

| Alloy | C | Si | Mn | P | S | Cr | Mo |
|---|---|---|---|---|---|---|---|
| A | 0.03 | 0.02 | 0.01 | 0.002 | 0.001 | 19.58 | 4.34 |
| B | 0.03 | 0.03 | 0.02 | 0.003 | 0.001 | 19.43 | 4.31 |
| | Co | Al | Ti | Fe | B | Zr | Ni |
| A | 13.54 | 3.02 | 1.35 | 0.54 | 0.005 | 0.05 | Bal |
| B | 13.47 | 1.46 | 3.10 | 0.97 | 0.006 | 0.06 | Bal |

These alloys were subjected to the forging and heat treatment as shown in TABLE 2, and tested to evaluate their strength characteristics and high-temperature sulfidation-corrosion resistance characteristics. In TABLE 2, those symbols given in the Alloy columns correspond to those in TABLE 1. Those indicated by symbol L in the Forge Condition columns represent the alloy specimens obtained by cogging steel ingots and subjected to repeated forging, and to finish forging (finish hot working) at 1010° C., and those indicated by symbol H represent the alloy specimens obtained by cogging steel ingots and subjected to repeated forging, and to finish forging (finish hot working) at 1080° C.

TABLE 2

| | Condition | Alloy | Forge condition | Specimen form | Solution heat treatment | Stabilizing treatment | Aging treatment | Secondary aging treatment |
|---|---|---|---|---|---|---|---|---|
| Comparative Example | 1 | A | L | BAR | 1010° C. × 4 h air-cooled | 843° C. × 4 h air-cooled | 760° C. × 16 h air-cooled | 650° C. × 16 h air-cooled |
| | 2 | A | L | BAR | 1010° C. × 4 h air-cooled | 843° C. × 4 h air-cooled | 760° C. × 16 h air-cooled | — |
| | 3 | A | L | BAR | 1025° C. × 4 h air-cooled | 843° C. × 4 h air-cooled | 760° C. × 16 h air-cooled | — |
| | 4 | B | L | BAR | 1010° C. × 4 h air-cooled | 843° C. × 4 h air-cooled | 760° C. × 16 h air-cooled | — |
| Invention | 5 | A | L | DS1 | 1010° C. × 4 h air-cooled | 880° C. × 4 h air-cooled | 730° C. × 16 h air-cooled | 650° C. × 16 h air-cooled |
| | 6 | A | L | DS1 | 1010° C. × 4 h air-cooled | 880° C. × 4 h air-cooled | 730° C. × 16 h air-cooled | — |
| | 7 | A | L | DS1 | 1025° C. × 4 h air-cooled | 880° C. × 4 h air-cooled | 700° C. × 16 h air-cooled | 650° C. × 16 h air-cooled |
| | 8 | A | L | DS1 | 1025° C. × 4 h air-cooled | 880° C. × 4 h air-cooled | 700° C. × 32 h air-cooled | 650° C. × 16 h air-cooled |
| | 9 | A | L | DS1 | 1025° C. × 4 h air-cooled | 880° C. × 4 h air-cooled | 730° C. × 16 h air-cooled | 650° C. × 16 h air-cooled |
| Comparative example | 20 | A | L | DS1 | 1040° C. × 4 h air-cooled | 843° C. × 4 h air-cooled | 760° C. × 16 h air-cooled | — |
| | 21 | B | L | BAR | 1040° C. × 4 h air-cooled | 843° C. × 4 h air-cooled | 760° C. × 16 h air-cooled | — |
| | 22 | A | H | DS2 | 1010° C. × 4 h air-cooled | 843° C. × 4 h air-cooled | 760° C. × 16 h air-cooled | 650° C. × 16 h air-cooled |
| | 23 | A | H | DS2 | 1025° C. × 4 h air-cooled | 843° C. × 4 h air-cooled | 760° C. × 16 h air-cooled | 650° C. × 16 h air-cooled |

Figure 1B:
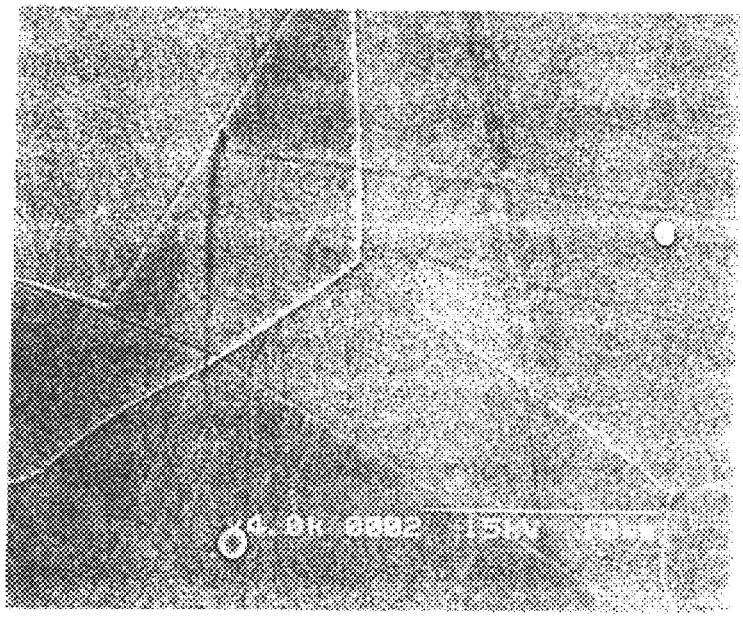

Note) Specimen form BAR: 60 × 130 × 1000 mm rectangular billet
DS1: 500 mm - dia. disc
DS2 : 1400 mm - dia. disc The relationship between forging temperature and carbide dissolving temperature was confirmed. To ascertain the relationship, 20-mm blocks were obtained from the forged specimens (forge condition L), heated and held at 1010° C. or 1080° C. for four hours. After air-cooled, the blocks were inspected for their microstructures with scanning electron microscope. The small specimens of 20-mm cube were used in the test to accelerate the cooling rate to prevent new Cr carbides from precipitating during cooling. FIGS. 1A and 1B show their microstructures observed by a scanning electron microscope. It was revealed that carbides were left in the grain boundaries after heated at 1010° C. (FIG. 1A), while virtually all of them entered into the solution after heated at 1080° C. (FIG. 1B). Consequently, this means that forge condition L corresponds to the forging at a temperature below the carbide dissolving temperature.

Figure 2A:
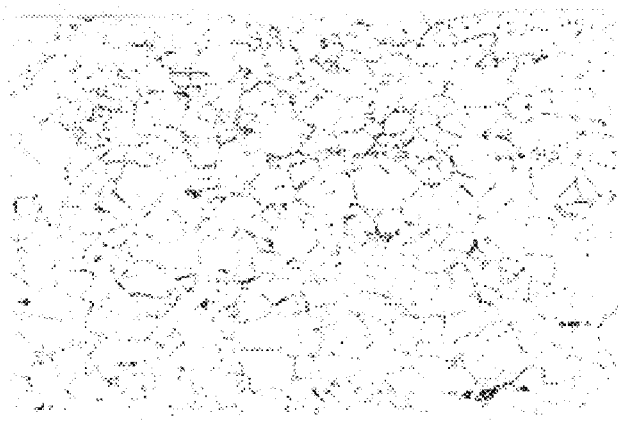
Figure 2B:
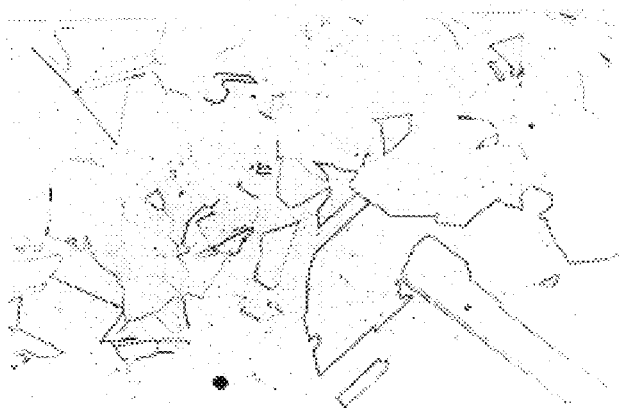

Next, the relationship between solution treatment temperature and recrystallization temperature was investigated. Finish-forged specimens (forge condition L) were heated and held at 1010° C. or 1040° C. for four hours, and then inspected for their microstructures in the same manner as the above example. The results are shown in FIG. 2. At the heating temperature of 1010° C., recrystallization hardly took place (FIG. 2A), while recrystallization took place almost invariably at 1040° C. (FIG. 2B). It follows from this that recrystallization temperature is in the temperature range exceeding 1010° C. and under 1040° C.

Next, blocks of a size enough to take various test specimens were obtained from samples of finish-forged alloys A and B, and subjected to various heat treatments as given in TABLE 2. Test specimens were prepared from the blocks and tested to determine their strength characteristics and high-temperature sulfidation-corrosion resistance characteristics.

Their strength characteristics were evaluated in terms of tensile strength characteristics at room temperature and 538° C. and creep rupture characteristics at a temperature of 732° C. and under a stress of 517 MPa. Their high-temperature sulfidation-corrosion resistance characteristics were evaluated in terms of the presence/absence of rupture and the depth of intergranular sulfidation corrosion as observed through cross-section observation by exposing the test specimens to a 600° C. $N_2$-3% $H_2$-0.1% $H_2S$ mixed gas atmosphere for 96 hours while applying a 588 MPa tensile stress. TABLE 3 shows the strength characteristics and high-temperature sulfidation-corrosion resistance characteristics of the test specimens.

TABLE 3

| | Strength test results | | | | | | | | | | High temperature sulfidation-corrosion test results |
|---|---|---|---|---|---|---|---|---|---|---|---|
| | Tensile properties at room temperature | | | | Tensile properties at elevated temperature □ | | | | Creep rupture properties (732□/517 MPa) | | |
| | 0.2% yield | Tensile | Elonga- | Reduction of | 0.2% yield | Tensile | Elonga- | Reduction of | Break | Elong- | Reduc tion of | Maximum intergranular corrosion depth (μm) |

| | Condi-tion | strength (MPa) | strength (MPa) | tion (%) | area (%) | strength (MPa) | strength (MPa) | tion (%) | area (%) | time (h) | ation (%) | area (%) | under tensile stress |
|---|---|---|---|---|---|---|---|---|---|---|---|---|---|
| Comparative example | 1 | 981 | 1334 | 21.2 | 32.1 | 918 | 1195 | 20.3 | 31.2 | 63.2 | 21.2 | — | 20 |
| | 2 | — | — | — | — | — | — | — | — | — | — | — | 25 |
| | 3 | — | — | — | — | — | — | — | — | — | — | — | 28 |
| | 4 | 1074 | 1432 | 19.4 | 36.2 | 965 | 1301 | 15.6 | 20.4 | 28.7 | 31.5 | — | 28 |
| Invention | 5 | 886 | 1329 | 26.7 | 41.5 | 833 | 1240 | 24.5 | 33.2 | 34.2 | 63.6 | 66.1 | 3 |
| | 6 | 859 | 1305 | 26.8 | 39.2 | 819 | 1201 | 26.2 | 30.9 | 30.8 | 50.1 | 52.1 | 5 |
| | 7 | 818 | 1262 | 26.1 | 33.9 | 755 | 1141 | 28.0 | 27.6 | 87.0 | 42.8 | 56.0 | 6 |
| | 8 | 839 | 1284 | 24.8 | 41.7 | 750 | 1146 | 24.0 | 25.6 | 55.0 | 41.9 | 52.8 | 5 |
| | 9 | 818 | 1283 | 29.7 | 39.4 | 76.8 | 1168 | 25.3 | 26.0 | 106.6 | 39.5 | 49.2 | 4 |
| Comparative example | 20 | 773 | 1216 | 28.5 | 27.7 | 806 | 1110 | 24.8 | 31.3 | 64.2 | 17.9 | 17.4 | 200 |
| | 21 | 924 | 1364 | 28.9 | 33 | 836 | 1214 | 18.5 | 22.8 | 61.7 | 19.3 | 16.1 | Ruptured after 19 h |
| | 22 | 878 | 1284 | 22.5 | 31.5 | 808 | 1171 | 224 | 27.8 | 107.6 | 47.1 | 54.2 | Ruptured after 88 h |
| | 23 | 926 | 1302 | 21.4 | 25.2 | 814 | 1163 | 21.5 | 25.2 | 105.6 | 42.2 | 45.3 | 1800 |

Note) □: Not measured

As for mechanical characteristics, it is revealed from the results given in TABLE 3 that the alloys subjected to the treatments according to the present invention have a sufficient strength because their mechanical properties are almost comparable to those of the conventional alloy (Waspaloy) which are on the levels of conditions 4 and 21 shown in TABLE 3. The alloys A and B which were subjected to the forging and heat treatments (under conditions 5 through 9) have a maximum corrosion depth as low as not more than 10 μm in a sulfidation corrosion environment. The alloys A and B which were subjected to the forging and heat treatments of the comparative examples, on the other hand, had an intergranular corrosion as deep as not less than 20 μm inside the alloys, or were ruptured halfway as they could not withstand the 96-hour exposure test.

Figure 3:
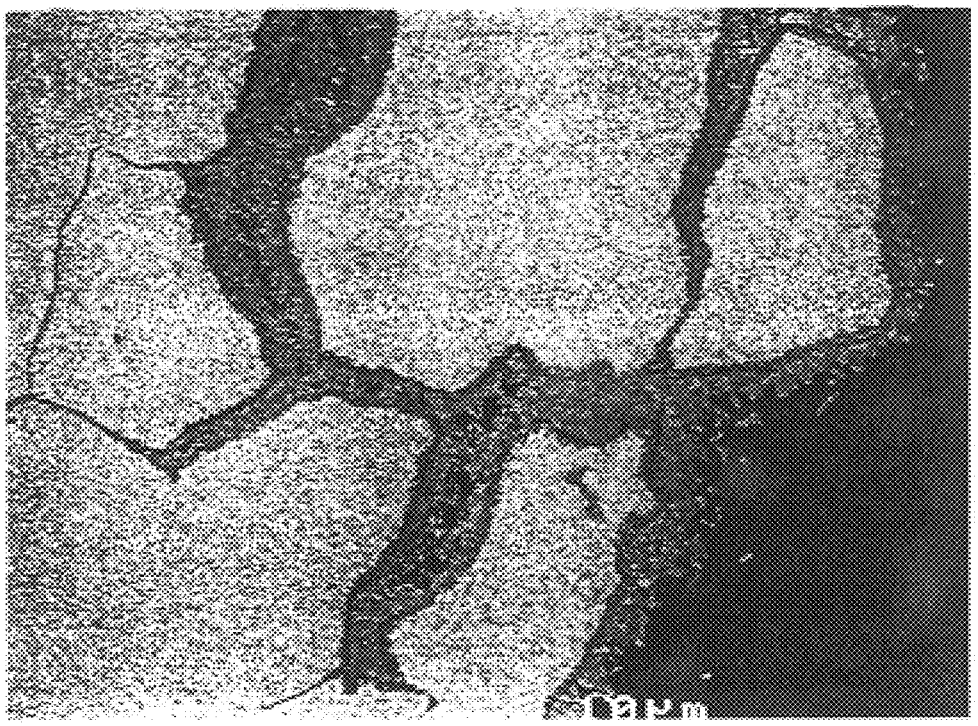
FIG. 3 is a cross-sectional micrograph of specimen treated under condition 21 and ruptured after subjected to 19-hour sulfidation corrosion under stress load condition.

A cross-section observation of the ruptured alloy which was treated under condition 21) revealed that the alloy was attacked by severe intergranular sulfidation corrosion, as shown in FIG. 3, indicating that intergranular sulfidation corrosion is responsible for the rupture of the alloy.

This is attributable to the fact that a high solid-solution treatment temperature accelerates the dissolving and recrystallization of carbides despite the low forging heating temperature, and the subsequent stabilizing and aging treatments causes carbides to precipitate in crystal grain boundaries newly formed as a result of the recrystallization, thereby forming Cr-depleted zones around the carbides, leading to deterioration in sulfidation-corrosion resistance, as described earlier. In the comparative examples (conditions 22 and 23), high-temperature sulfidation corrosion resistance was not sufficient because the high forging heating temperature was too high, though the solid-solution treatment temperature was low.

Moreover, test specimens of Nos. 5 to 9 which were subjected to stabilizing treatment at not lower than 860° C. and not higher than 920° C. and aging treatment at not lower than 680° C. and not higher than 760° C. had maximum intergranular corrosion depth as small as not more than 10 μm, and far better high-temperature sulfidation-corrosion resistance than those treated under conditions 1 through 4.

The reasons can be understood from an intergranular corrosion region map prepared through the Streicher test below.

The Streicher test is designed to examine the degree of the formation of Cr-depleted zones caused by the precipitation of intergranular carbides (susceptibility to intergranular corrosion). As described above, the intergranular sulfidation corrosion put in question here is attributable to the formation of Cr-depleted zones in the vicinity of grain boundaries caused by the precipitation of Cr carbides at grain boundaries. Consequently, the degree of the Cr-depleted zones evaluated in the Streicher test can be considered proportional to intergranular sulfidation-corrosion resistance. This was confirmed by comparing the results of the Streicher tests and hot sulfidation corrosion tests.

Figure 4:
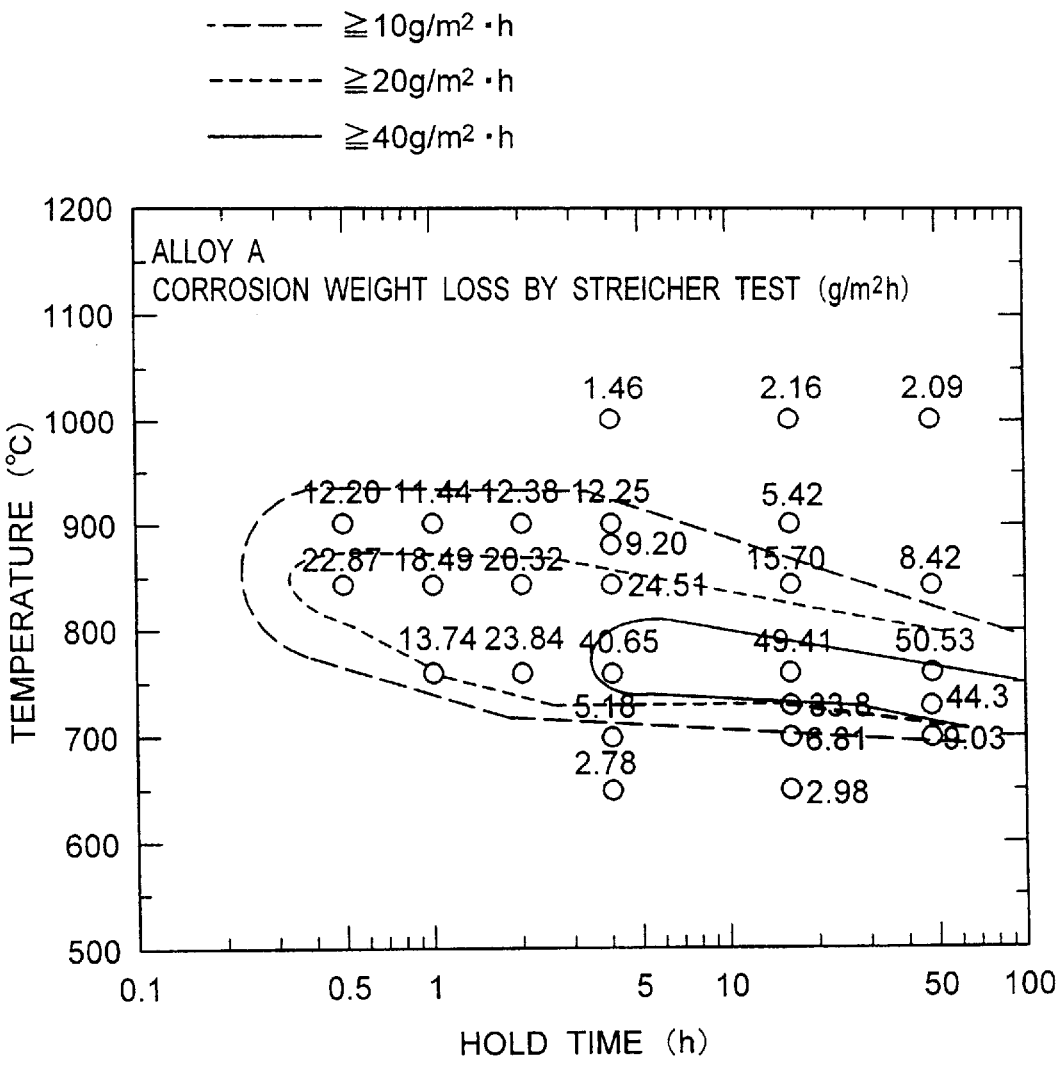
FIG. 4 shows temperature time intergranular corrosion sensitivity curves in the Streicher test.

TABLE 4 shows heat treatment conditions treated to test specimens for the Streicher tests. As the test specimens, alloy A treated under forge condition L was used. FIG. 4 shows an intergranular corrosion region map in which the region of Cr-depleted zone formation is shown by plotting the corrosion weight loss in the Streicher tests with respect to temperature and time.

TABLE 4

| Conditions | Solution heat treatment conditions | Stabilization treatment or aging treatment conditions |
|---|---|---|
| a | 1040° C. × 4 h air-cooled | 1000° C. × 4 h air-cooled |
| b | 1040° C. × 4 h air-cooled | 1000° C. × 16 h air-cooled |
| c | 1040° C. × 4 h air-cooled | 1040° C. × 48 h air-cooled |
| d | 1040° C. × 4 h air-cooled | 900° C. × 0.5 h air-cooled |
| e | 1040° C. × 4 h air-cooled | 900° C. × 1 h air-cooled |
| f | 1040° C. × 4 h air-cooled | 900° C. × 2 h aircooled |
| g | 1040° C. × 4 h air-cooled | 900° C. × 4 h air-cooled |
| h | 1040° C. × 4 h air-cooled | 900° C. × 16 h air-cooled |
| i | 1040° C. × 4 h air-cooled | 880° C. × 4 h air-cooled |
| j | 1040° C. × 4 h air-cooled | 843° C. × 0.5 h air-cooled |
| k | 1040° C. × 4 h air-cooled | 843° C. × 1 h air-cooled |
| l | 1040° C. × 4 h air-cooled | 843° C. × 4 h air-cooled |
| m | 1040° C. × 4 h air-cooled | 843° C. × 16 h air-cooled |
| n | 1040° C. × 4 h air-cooled | 843° C. × 48 h air-cooled |
| o | 1040° C. × 4 h air-cooled | 760° C. × 1 h air-cooled |
| p | 1040° C. × 4 h air-cooled | 760° C. × 2 h air-cooled |
| q | 1040° C. × 4 h air-cooled | 760° C. × 4 h air-cooled |
| r | 1040° C. × 4 h air-cooled | 760° C. × 16 h air-cooled |
| s | 1040° C. × 4 h air-cooled | 760° C. × 48 h air-cooled |
| t | 1040° C. × 4 h air-cooled | 730° C. × 16 h air-cooled |
| u | 1040° C. × 4 h air-cooled | 730° C. × 48 h air-cooled |
| v | 1040° C. × 4 h air-cooled | 700° C. × 4 h air-cooled |
| w | 1040° C. × 4 h air-cooled | 700° C. × 16 h air-cooled |
| x | 1040° C. × 4 h air-cooled | 700° C. × 48 h air-cooled |

It is found from FIG. 4 that the temperature zones of the 843° C.×4h air-cooled stabilization treatment and the 760° C.×16h air-cooled aging treatment that have been commonly practiced are one of the heat treatment conditions where susceptibility to intergranular corrosion becomes most remarkable, and cannot be regarded as the optimum conditions at least for high temperature sulfidation-corrosion resistance. It is also found that when stabilization treatment in a higher temperature region and aging treatment in a lower temperature region are practiced, susceptibility to intergranular corrosion becomes lower, and high temperature sulfidation-corrosion resistance is improved. As discussed above, the present invention makes it possible to perform stabilization treatment after solution heat treatment at higher temperatures than with the conventional treatment conditions, and aging treatment at lower temperatures than the conventional conditions, thereby remarkably improving high temperature sulfidation-corrosion resistance. This matches with the results of alloys treated under Conditions 5 through 9 in TABLE 3.

The above-mentioned test results suggest that high temperature sulfidation-corrosion resistance can be remarkably improved while maintaining almost the same strength properties at elevated temperature by applying the forging and heat treatment according to the present invention to a Ni-based heat-resistant.

As described above, the present invention provides a Ni-based alloy having improved sulfidation-corrosion resistance, particularly intergranular corrosion resistance while maintaining sufficient high-temperature strength properties, compared with conventional heat treatment methods in which emphasis is placed on strength alone. Thus, the present invention can provide equipment components having high reliability in sulfidation corrosive environment.

With the lowering quality of fossil fuel resulting from the needs for reduced loads on the environment and energy conservation, and increased efficiency of energy equipment in recent years, service environments of high-temperature equipment, such as turbines and boilers, are becoming increasingly stringent. Consequently, inventions concerning the improved corrosion resistance of equipment components, such as the present invention, will have great significance in the future.

What is claimed is:

1. A manufacturing method of Ni-based alloy having improved sulfidation-corrosion resistance containing 0.005 to 0.1 mass % C, 18 to 21 mass % Cr, 12 to 15 mass % Co, 3.5 to 5.0 mass % Mo, not more than 3.25 mass % Ti, and 1.2 to 4.0 mass % Al, with the balance substantially comprising Ni, which method comprises the steps of:

finish hot-working the alloy at a temperature below carbide dissolving temperature;

solution treating the alloy at a temperature below the carbide dissolving temperature and below re-crystallization temperature;

stabilizing treating the alloy at a temperature of 860° C. to 920° C. for 1 to 16 hours; and aging treating the alloy at a temperature of 680° C. to 760° C. for 4 to 48 hours.

2. A manufacturing method as set forth in claim 1 wherein the alloy is further subjected to a secondary aging treatment at a temperature not lower than 620° C. while not higher than the aging treatment temperature minus 20° C. for not less than 8 hours.

3. A manufacturing method as set forth in claim 1 wherein the alloy contains not more than 2.75 mass % Ti and 1.6 to 4.0 mass % Al.

4. A manufacturing method as set forth in claim 3 wherein the alloy is further subjected to a secondary aging treatment at a temperature not lower than 620° C. while not higher than the aging treatment temperature minus 20° C. for not less than 8 hours.

5. A manufacturing method as set forth in claim 1 wherein the alloy contains any one of not more than 0.01 mass % B and not more than 0.1 mass % Zr.

6. A manufacturing method as set forth in claim 5 wherein the alloy is further subjected to a secondary aging treatment at a temperature not lower than 620° C. while not higher than the aging treatment temperature minus 20° C. for not less than 8 hours.

* * * * *